US009038862B2

(12) United States Patent
McNulty et al.

(10) Patent No.: US 9,038,862 B2
(45) Date of Patent: May 26, 2015

(54) PUMPS WITH CONTAINER VENTS

(71) Applicants: John J. McNulty, Broadview Heights, OH (US); Nick E. Ciavarella, Seven Hills, OH (US); Robert L. Quinlan, Stow, OH (US); Cory J. Tederous, Stow, OH (US)

(72) Inventors: John J. McNulty, Broadview Heights, OH (US); Nick E. Ciavarella, Seven Hills, OH (US); Robert L. Quinlan, Stow, OH (US); Cory J. Tederous, Stow, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 13/747,909

(22) Filed: Jan. 23, 2013

(65) Prior Publication Data

US 2014/0203047 A1 Jul. 24, 2014

(51) Int. Cl.

| | |
|---|---|
| ***B65D 88/54*** | (2006.01) |
| ***A47K 5/14*** | (2006.01) |
| ***B05B 7/00*** | (2006.01) |
| ***B05B 11/00*** | (2006.01) |

(52) U.S. Cl.

CPC ..... *A47K 5/14* (2013.01); *B05B 7/0025* (2013.01); *B05B 11/0016* (2013.01); *B05B 11/0018* (2013.01); *B05B 11/3015* (2013.01); *B05B 11/3087* (2013.01)

(58) Field of Classification Search

USPC ..... 222/190, 181.1–181.3, 325, 478–489

See application file for complete search history.

(56) References Cited

U.S. PATENT DOCUMENTS

| | | | | | |
|---|---|---|---|---|---|
| 585,327 | A | * | 6/1897 | Guttenberg | 222/482 |
| 922,453 | A | * | 5/1909 | Burgner | 222/181.2 |
| 1,167,420 | A | * | 1/1916 | Marcuse | 222/340 |
| 1,207,278 | A | * | 12/1916 | Cordley | 222/131 |
| 1,207,505 | A | * | 12/1916 | Cordley | 222/185.1 |
| 1,220,753 | A | * | 3/1917 | Kees | 222/131 |
| 1,303,708 | A | * | 5/1919 | Moffitt | 222/158 |
| 1,553,113 | A | * | 9/1925 | Rutt | 222/484 |
| 2,464,030 | A | * | 3/1949 | Engstrom | 222/309 |
| 2,529,365 | A | * | 11/1950 | Barksdale | 222/181.2 |

(Continued)

FOREIGN PATENT DOCUMENTS

| | | | |
|---|---|---|---|
| CH | 676227 | A5 | 12/1990 |
| EP | 1147818 | A1 | 10/2001 |

(Continued)

OTHER PUBLICATIONS

International Search Report and Written Opinion from International Application No. PCT/US2014/035072, date of mailing Jul. 23, 2014.

(Continued)

*Primary Examiner* — Patrick M Buechner

(74) *Attorney, Agent, or Firm* — Calfee, Halter & Griswold LLP

(57) ABSTRACT

Exemplary embodiments of pumps, refill units and dispensers are disclosed herein. Some embodiments include a container for holding a fluid and a pump housing secured to the container. The pump housing includes an annular collar for securing the pump housing to the container. The pump housing includes an air chamber and a vent valve located at least partially within the air chamber. One or more air passageways are provided in the collar for providing air to the air chamber. A compressible liquid pump chamber is also located in the housing. The exemplary embodiment includes a liquid inlet valve for allowing liquid to flow from the container into the compressible pump chamber; and a liquid outlet valve located downstream of the pump chamber.

22 Claims, 4 Drawing Sheets

(56) References Cited

U.S. PATENT DOCUMENTS

| | | | | |
|---|---|---|---|---|
| 2,605,021 | A * | 7/1952 | Churchill et al. | 222/153.03 |
| 2,904,222 | A | 9/1959 | Philippe | |
| 3,200,994 | A * | 8/1965 | Levinson et al. | 222/82 |
| 3,851,801 | A | 12/1974 | Roth | |
| 4,168,020 | A | 9/1979 | Benson | |
| 4,321,938 | A * | 3/1982 | Siller | 137/99 |
| 4,330,071 | A | 5/1982 | Ohlson | |
| 4,360,130 | A * | 11/1982 | Nishimura et al. | 222/153.09 |
| 4,493,440 | A * | 1/1985 | von Buelow et al. | 222/109 |
| 4,793,522 | A | 12/1988 | Corsette | |
| 4,880,161 | A | 11/1989 | Wright | |
| 4,930,667 | A * | 6/1990 | Holzner, Sr. | 222/189.09 |
| 4,986,453 | A | 1/1991 | Lina et al. | |
| 5,033,654 | A * | 7/1991 | Bennett | 222/190 |
| 5,037,006 | A * | 8/1991 | Kock | 222/190 |
| 5,271,530 | A | 12/1993 | Uehira et al. | |
| 5,439,140 | A | 8/1995 | Meyer | |
| 5,445,288 | A * | 8/1995 | Banks | 222/95 |
| 5,462,208 | A | 10/1995 | Stahley et al. | |
| 5,826,755 | A | 10/1998 | Burd | |
| 5,862,954 | A | 1/1999 | Ehrensperger | |
| 5,899,363 | A | 5/1999 | Bliss, III et al. | |
| 5,906,299 | A | 5/1999 | Hagleitner | |
| 6,016,936 | A * | 1/2000 | Fan | 222/181.1 |
| 6,065,647 | A | 5/2000 | Bliss, III et al. | |
| 6,082,586 | A * | 7/2000 | Banks | 222/95 |
| 6,446,840 | B2 | 9/2002 | Ophardt et al. | |
| 6,540,111 | B2 * | 4/2003 | Sunnarborg | 222/129 |
| 6,688,499 | B2 * | 2/2004 | Zhang | 222/413 |
| 6,971,549 | B2 | 12/2005 | Leifheit et al. | |
| 6,986,443 | B2 * | 1/2006 | Laible | 222/181.1 |
| 7,021,494 | B2 * | 4/2006 | Mazooji et al. | 222/83 |
| 7,059,282 | B2 | 6/2006 | Vorih et al. | |
| 7,308,990 | B2 * | 12/2007 | Mazooji et al. | 222/83 |
| 7,377,758 | B2 | 5/2008 | Sallows et al. | |
| 7,461,762 | B2 * | 12/2008 | Law et al. | 222/190 |
| 7,641,077 | B2 * | 1/2010 | Law et al. | 222/190 |
| 7,708,166 | B2 * | 5/2010 | Ophardt | 222/190 |
| 7,815,076 | B2 | 10/2010 | Ophardt | |
| 7,938,297 | B2 * | 5/2011 | Law et al. | 222/190 |
| 8,047,403 | B2 * | 11/2011 | Quinlan et al. | 222/190 |
| 8,047,404 | B2 * | 11/2011 | Quinlan et al. | 222/190 |
| 8,474,664 | B2 * | 7/2013 | Ophardt et al. | 222/190 |
| 8,579,159 | B2 | 11/2013 | Ciavrella | |
| 8,662,356 | B2 * | 3/2014 | Padain et al. | 222/325 |
| 2002/0153389 | A1 * | 10/2002 | Creaghan et al. | 222/190 |
| 2003/0000967 | A1 | 1/2003 | Ehrensperger | |
| 2004/0031816 | A1 | 2/2004 | Schuman | |
| 2004/0206772 | A1 | 10/2004 | Leifheit | |
| 2005/0284887 | A1 * | 12/2005 | Lewis et al. | 222/181.3 |
| 2006/0273114 | A1 | 12/2006 | Ophardt | |
| 2008/0272148 | A1 | 11/2008 | Malik et al. | |
| 2009/0200338 | A1 * | 8/2009 | Quinlan et al. | 222/190 |
| 2009/0308894 | A1 * | 12/2009 | Ophardt | 222/190 |
| 2010/0096412 | A1 | 4/2010 | Law | |
| 2011/0079614 | A1 | 4/2011 | Ganzeboom et al. | |
| 2012/0067923 | A1 * | 3/2012 | Matthews et al. | 222/190 |
| 2012/0074171 | A1 * | 3/2012 | Quinlan et al. | 222/190 |
| 2013/0315031 | A1 | 11/2013 | Bunoz et al. | |

FOREIGN PATENT DOCUMENTS

| | | | |
|---|---|---|---|
| EP | 2080464 | A2 | 7/2009 |
| EP | 2080560 | A1 | 7/2009 |
| GB | 1269545 | | 4/1972 |
| GB | 2301812 | | 12/1996 |
| GB | 2472235 | | 2/2011 |
| WO | 2011157975 | A1 | 12/2011 |

OTHER PUBLICATIONS

European Patent Office Search Report issued Jan. 7, 2011 in EP Application No. 09 150 880.2; 4 pages.

International Search Report and Written Opinion from International Application No. PCT/US2013/056106, date of mailing Nov. 7, 2013; 10 pages.

International Search Report and Written Opinion from International Application No. PCT/US2013/067158, date of mailing Apr. 11, 2014; 16 pages.

International Search Report and Written Opinion from International Application No. PCT/US2013/067366, date of mailing Apr. 11, 2014; 18 pages.

International Search Report and Written Opinion from International Application No. PCT/US2013/056964, date of mailing Nov. 7, 2013; 12 pages.

International Search Report and Written Opinion from International Application No. PCT/US2013/056549, date of mailing Jan. 15, 2014; 16 pages.

International Search Report and Written Opinion from International Application No. PCT/US2014/012440, date of mailing Jun. 23, 2014.

* cited by examiner

PUMPS WITH CONTAINER VENTS

TECHNICAL FIELD

The present invention relates generally to pumps, refill units for dispensers, and dispensers, and more particularly to pumps, refill units and dispensers that have a non-collapsible container that requires venting.

BACKGROUND OF THE INVENTION

Liquid dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles. Many dispensers are refillable with refill units that comprise a pump (or a pump and an air compressor) and a container. Many of the refill units currently on the market are inverted. In an inverted refill unit, the pump is located under the container when installed in the dispenser and the containers are often "collapsible" containers. That is, as liquid is pumped out of the container, a vacuum is created in the container and the vacuum pressure collapses the container because air does not flow into the container to replace the liquid. Providing a vent in the bottom of the container subjects the container to potential leakage problems.

SUMMARY

Exemplary embodiments of pumps, refill units and dispensers are disclosed herein. Some embodiments include a container for holding a fluid and a pump housing secured to the container. The pump housing includes an annular collar for securing the pump housing to the container. The pump housing also includes an air chamber and a vent valve located at least partially within the air chamber. One or more air passageways are provided in the collar for providing air to the air chamber. A compressible liquid pump chamber is also located in the housing. The exemplary embodiment includes a liquid inlet valve for allowing liquid to flow from the container into the compressible pump chamber and a liquid outlet valve located downstream of the pump chamber.

Another exemplary refill unit includes a container for holding a fluid and a pump housing secure to the container. The pump housing has an annular collar for securing the pump housing to the container. A seat member is located at least partially within the annular collar. An air chamber is located within the pump housing below the seat member. One or more air passageways are in the collar for providing air to the air chamber. A vent valve is secured to the seat member for controlling the flow of air from the air chamber into the container. A compressible liquid pump chamber is also located in the housing. A liquid inlet valve is secured to the seat member for allowing liquid to flow from the container into the compressible pump chamber, and a liquid outlet valve is located downstream of the pump chamber.

Another exemplary refill unit includes a container for holding a liquid. A housing is secured to the container. The housing includes an opening with a sleeve located in the opening. A piston is provided that is movable within the sleeve. The piston includes a sealing member. The housing includes first aperture through a wall of the opening. The first aperture places an area between the sleeve and the opening in fluid communication with the interior of the container. A second aperture through a wall of the sleeve is provided. The second aperture is located so that the second aperture is closed off by the sealing member when the piston is in a first position. When the piston is in a second position, the second aperture is in fluid communication with the atmosphere.

Another exemplary refill unit includes a container and a pump housing secured to the container. The pump housing includes a substantially cylindrical valve cavity and a substantially cylindrical pump cavity. A sleeve is located at least partially within the pump cavity. An aperture places the valve cavity in fluid communication with the pump cavity. A piston is provided, and the piston is movable horizontally within the sleeve. An inlet valve and an outlet valve are stacked on each other and are offset from the neck of the container.

Exemplary pumps are also disclosed herein, and the exemplary embodiments of refill units described above include the exemplary embodiments of the pumps. Similarly, the above described refill units may be used in dispensers.

BRIEF DESCRIPTION OF THE DRAWINGS

These and other features and advantages of the present invention will become better understood with regard to the following description and accompanying drawings in which.

DETAILED DESCRIPTION

Figure 1:
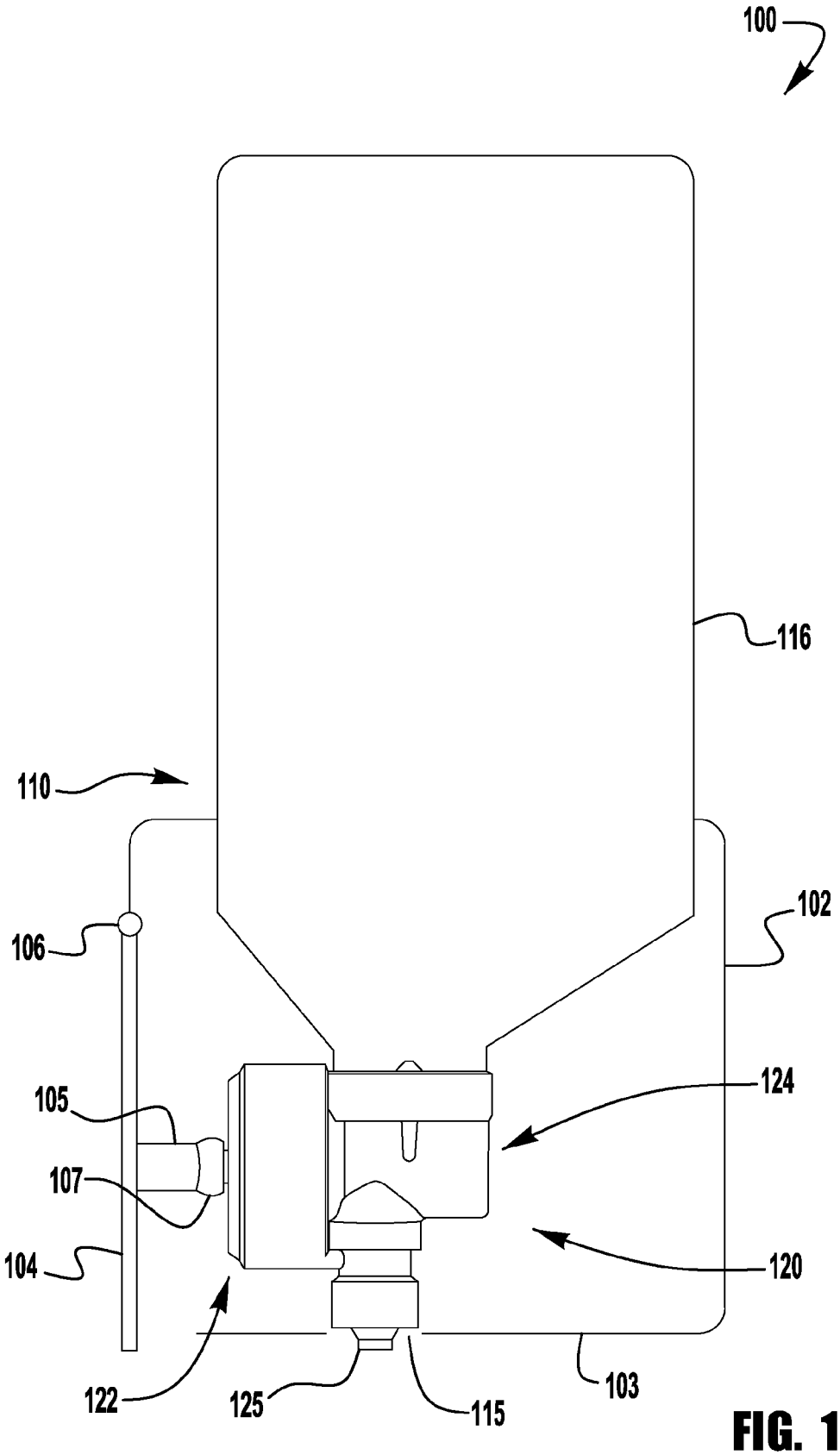
FIG. 1 is a cross-section of an exemplary foam dispenser having a refill unit with a non-collapsible container.

FIG. 1 illustrates an exemplary embodiment of a foam dispenser 100. The cross-section of FIG. 1 is taken through the housing 102 to show the foam pump 120 and container 116. Foam dispenser 100 includes a disposable refill unit 110. The disposable refill unit 110 includes a non-collapsible container 116 connected to foam pump 120. The foam dispenser 100 may be a wall-mounted system, a counter-mounted system, an un-mounted portable system movable from place to place or any other kind of foam dispenser system. Some of the exemplary embodiments described herein have foam pumps; that is, they contain a liquid pump and an air compressor. However, the inventive venting system described herein works equally well with a liquid pump that does not include an air compressor.

The container 116 forms a liquid reservoir that contains a supply of a foamable liquid within the disposable refill unit 110. In various embodiments, the contained liquid could be for example a soap, a sanitizer, a cleanser, a disinfectant or some other liquid that may be foamable or not foamable (in the case of a liquid only pump). In the exemplary disposable refill unit 110, the container 116 is a non-collapsible container and can be made of thin plastic or like material. In other embodiments, the container 116 may be formed by a rigid housing member, or have any other suitable configuration for containing the foamable liquid without leaking. The container 116 may advantageously be refillable, replaceable or both refillable and replaceable.

In the event the liquid stored in the container 116 of the installed disposable refill unit 110 runs out, or the installed refill unit 110 otherwise has a failure, the installed refill unit 110 may be removed from the foam dispenser 100. The empty or failed disposable refill unit 110 may then be replaced with a new disposable refill unit 110.

In one embodiment, the housing 102 of the foam dispenser 100 only extends part way around the container 116 thereby exposing at least a portion of the container 116. In such an embodiment, having a container that does not collapse as liquid is pumped out is aesthetically pleasing. The housing 102 of the foam dispenser 100 contains one or more actuating members 104 to activate the pump 120. As used herein, actuator or actuating members or mechanism includes one or more parts that cause the dispenser 100 to move liquid, air or foam. Actuator 104 is generically illustrated because there are many different kinds of pump actuators which may be employed in the foam dispenser 100. The actuator of the foam dispenser 100 may be any type of actuator such as, for example, a manual lever, a manual pull bar, a manual push bar, a manual rotatable crank, an electrically-activated actuator or other means for actuating the foam pump 120 which includes a liquid pump portion 124 and air compressor portion 122. Electronic actuators may additionally include a sensor (not shown) to provide for a hands-free dispenser system with touchless operation. In one embodiment, actuator 104 is connected to housing 102 by a hinge member 106. Various intermediate linkages, such as for example linkage 105, connect the actuator member 104 to the foam pump 120 within the system housing 102. In one embodiment, linkage 105 has a socket 107 that snaps onto a ball 245 (FIG. 2) at the proximate end of piston 240. An aperture 115 in bottom plate 103 of housing 102 allows foam dispensed from the nozzle 125 of foam pump 120 to be dispensed to a user.

Figure 2:
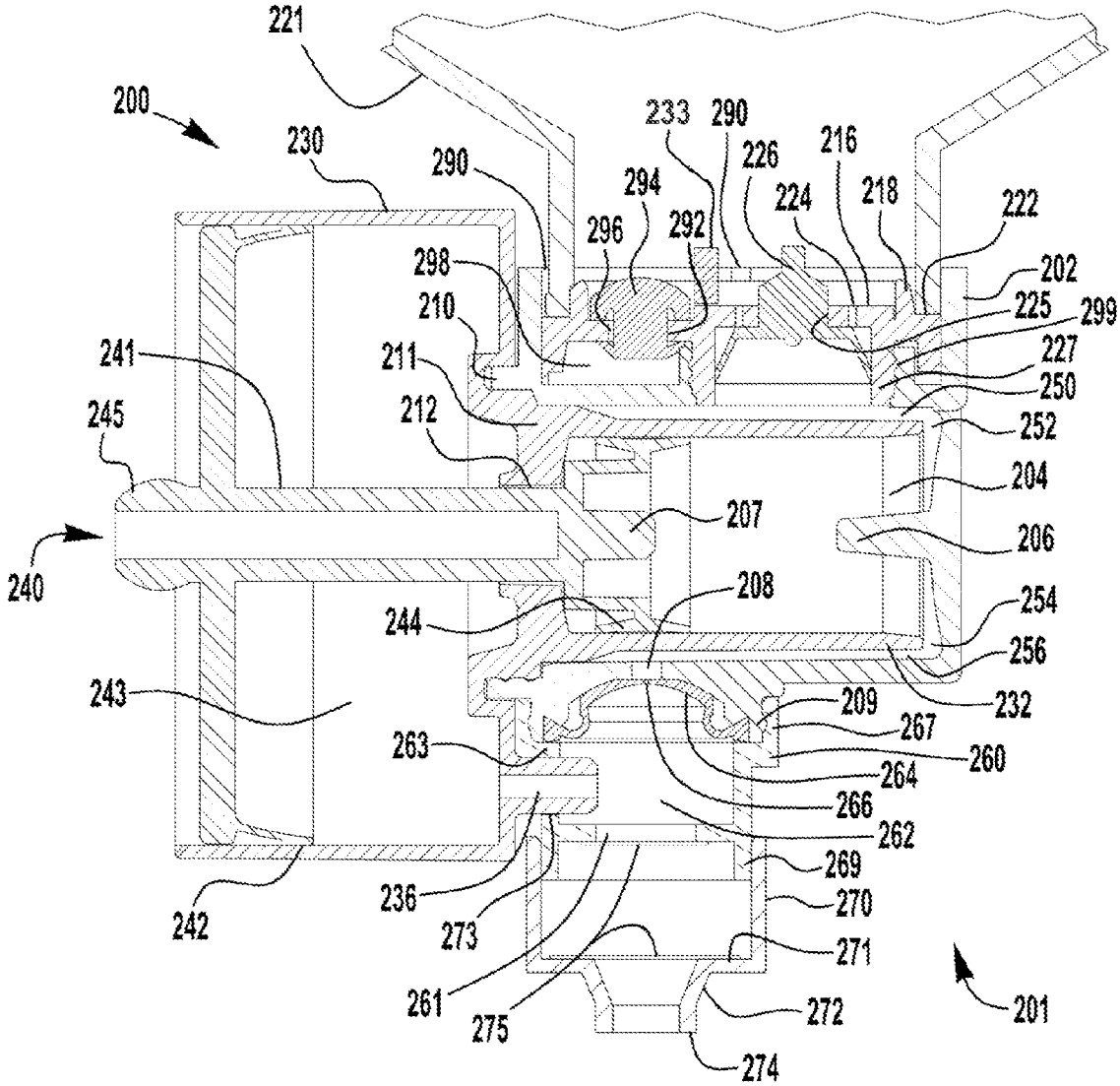
FIG. 2 is a cross-section of an exemplary refill unit with a pump and a container vent.

FIG. 2 is a cross-sectional view of an exemplary embodiment of a refill unit 200 suitable for use in foam dispensers. Refill unit 200 includes a non-collapsible container 221 for holding a foamable liquid connected to a foam pump 201. Foam pump 201 includes a housing 202. Housing 202 receives seat member 216. Seat member 216 includes an annular projection 218. A neck of a container 221 is received within an annular groove 222 formed between annular projection 218 and housing 202. Housing 202 may be connected to the container 221 by any means such as, for example, a snap-fit connection, a threaded connection, a welded connection, an adhesive connection or the like.

Seat member 216 includes one or more liquid inlet apertures 224 located therethrough. In addition, seat member 216 includes an inlet valve retaining aperture and one-way inlet valve 226 is secured to seat member 216 therethrough. One-way liquid inlet valve 226 may be any type of one-way valve such as, for example, a ball and spring valve, a poppet valve, a flapper valve, an umbrella valve, a slit valve, a mushroom valve, a duck-bill valve or the like.

In addition, seat member 216 includes an air inlet aperture 292 and one-way air inlet valve 294. One-way air inlet valve 294 includes one or more air inlet apertures 296. Housing 202 includes an annular projection 299 that engages with a second annular projection 227 of seat member 216 to form a liquid passageway on the inside of first annular projection 299 and second annular projection 227. Located outside of the first annular projection 299 and second annular projection 227 is an air chamber 298. Housing 202 includes one or more small channels 290 between the neck of the container 221 and housing 202 that form an air passageway to provide air from the outside atmosphere to the air chamber 298.

During operation, as liquid is pumped out of container 221, a vacuum is created inside the container 221. Once the vacuum pressure rises above the cracking pressure of the air inlet valve 294, air from air chamber 298 is drawn into container 221 to relieve the vacuum pressure. Liquid is prevented from leaking out of container 221 by one-way air inlet valve 294. In addition, in one embodiment, the channels 290 in housing 202 that form the air passage are very small and if a small amount of liquid enters air chamber 298 it is trapped in the air chamber 298 and will not leak through the channels 290. In one embodiment, seat member 216 includes a deflector member 233 between liquid inlet valve 226 and air inlet valve 294 to prevent air from being sucked into the liquid inlet.

Pump housing 202 includes a liquid chamber 204. In one embodiment liquid chamber 204 is cylindrical. Located at least partially within liquid chamber 204 is a sleeve 232. Housing 202 includes an annular projection 210 at one end of the liquid chamber 204. Sleeve 232 is secured to annular projecting member 210 by collar 211. Collar 211 includes an aperture 212.

A piston 240 includes a shaft 241 that projects through aperture 212. Piston 240 is slideable in a reciprocating manner within sleeve 232. Piston 240 includes a piston head having a double wiper seal 244 located at the distal end. Movement of piston 240 causes the volume of liquid chamber 204 to expand and contract. Double wiper seal 244 may be any type of sealing member such as, for example, an o-ring, a single wiper seal or the like. Housing 202 includes a projecting member 206 that contacts an end 207 of piston 240 to stop movement of piston 240 when it reaches the end of its stroke.

In addition, piston 240 includes a second piston head and sealing member 242 located at the proximal end of piston 240. Second sealing member 242 engages the inside of the air compressor housing 230. The term "air compressor" may be used interchangeably herein with the term "air pump." In one embodiment, air compressor housing 230 and sleeve 232 are formed as one piece. Movement of piston 240 causes air chamber 243 to expand and contract. Air chamber 243 includes an air outlet 236, which is also an air inlet to mixing chamber 262. In one embodiment, air outlet 236 is integrally formed with both sleeve 232 and air compressor housing 230.

A liquid inlet passageway 250 is formed between sleeve 232 and the wall of liquid chamber 204. The liquid inlet passageway 250 may extend entirely around sleeve 232 or may be enclosed by one or more rib projections (not shown) that cause liquid in inlet passageway 250 to flow through passage 250 and passage 252 into the interior of sleeve 232. Outlet passages 254, 256 also exist between sleeve 232 and the walls of liquid chamber 204. Outlet passageway 256 may extend entirely around sleeve 232 or may be enclosed by one or more rib projections (not shown) that cause liquid to flow from the interior of sleeve 232 through passageways 254, 256. Passageway 254 and passageway 250 may be connected to form a common passageway.

Housing 202 includes an outlet passage 208. Connected to housing 202 is lower housing 260. Lower housing 260 may be connected to housing 202 by any means such as, for example, a threaded connection, a snap-fit connection, a welded connection an adhesive connection or the like. In the present exemplary embodiment, lower housing 260 includes annular projection 267 that snaps onto annular projection 209 of housing 202. Located proximate outlet passage 208 is a liquid outlet valve 264. Liquid outlet valve 264 includes a slit 266. Slit 266 opens to allow liquid to flow from liquid chamber 204 into mixing chamber 262. The backing provided by the wall surrounding the liquid outlet 208 prevents the slit 266 from opening when there is pressure in mixing chamber 262 and prevents liquid and/or air from entering liquid chamber 204 from mixing chamber 262. Liquid outlet valve 264 is retained in place by annular rim 263 on lower housing member 260. While a slit valve is shown and advantageously takes up very little room, other types of liquid outlet valves may be used such as, for example, a ball and spring valve, a flapper valve, a poppet valve, a mushroom valve, a duck-bill valve or the like.

Lower housing 260 has an interior cavity that forms a mixing chamber 262. Lower housing 260 includes an opening 273 in the wall of mixing chamber 262. The air outlet 236 of air chamber 243 is fitted into opening 273 to allow mixing chamber 262 to be in fluid communication with air chamber 243. Mixing chamber 262 is in fluid communication with liquid chamber 204 through valve 264. In addition, lower housing 260 includes an outlet opening 261 and a lower annular projection 269. Outlet nozzle 270 fits over lower projection 269 to secure outlet nozzle 270 to lower housing 260. Outlet nozzle 270 is secured using a press-fit connection, but may be connected by other means such as, for example, a snap-fit connection, an adhesive, a threaded connection or the like. Outlet nozzle 270 includes a base 271, a tapered portion 272 and an outlet 274. In addition, a foaming media 275, such as one or more screens, is included in outlet nozzle 270. Optionally, a foaming cartridge may be used whereby the foaming cartridge rests on base 271. In some embodiments, screens 275 are replaced by one or more porous members or baffles.

An exemplary benefit to using sleeve 232 is that the liquid inlet 224, or liquid inlet valve 226 may be positioned over any portion of the sleeve 232 without affecting the volume of liquid chamber 204 or reducing the efficiency of pump 201. Similarly, the liquid outlet 208 and/or liquid outlet valve 264 may be located along any portion of the sleeve 232 without reducing the volume of liquid chamber 204 or reducing the efficiency of pump 201. In some embodiments, the liquid inlet and the liquid outlet are off-set from each other. In some embodiments, the liquid outlet is located closer to the front of the dispenser than the liquid inlet when the pump 201 is installed in the foam dispenser. In some embodiments, the liquid inlet and liquid outlet are along a common axis. The piston 240 may move along a pump axis that is substantially horizontal. In some embodiments, the liquid inlet valve 226 moves along an axis that is substantially normal to the pump axis. In some embodiments, at least a portion of the liquid inlet valve 226 moves along a substantially vertical axis even though it may collapse both horizontally and vertically.

In addition, although the pump 201 has been described as being made of selected sub-parts, pump 201, as well as the other embodiments of pumps disclosed herein, may be made from more sub-parts or fewer sub-parts.

During operation, as piston 240 of pump 201 moves from a discharged position to a charged position or primed state, liquid flows in through liquid inlet 224, past one-way inlet valve 226, into liquid chamber 204, through passages 250, 252 and into the interior of sleeve 232, which also forms a portion of the liquid chamber 204.

Movement of piston 240 from the charged position to the discharged position causes fluid to flow out of the liquid chamber 204 (including the center of the sleeve 232) through passages 254, 256, past liquid outlet valve 264 and into mixing chamber 262. Simultaneously, the volume of air chamber 243 is reduced and air flows out of air outlet 236 into mixing chamber 262. The air and liquid mixture is forced through opening 261 and through foam media 275 to create a rich foam. The rich foam travels through tapered section 272 where it accelerates due to the reduced volume and exits foam pump 201 through outlet 274.

The air compressors and liquid pumps described herein may include biasing members to return them to a charged or primed state. In some embodiments, a biasing member in the actuator mechanism returns the air compressor and/or liquid pump to a first state. Still yet, if the air compressor and/or liquid pump are electrically operated, they may be moved to the first state electronically.

In some embodiments, the foam pump 201 is replaced with a liquid pump that does not include an air compressor.

Figure 3:
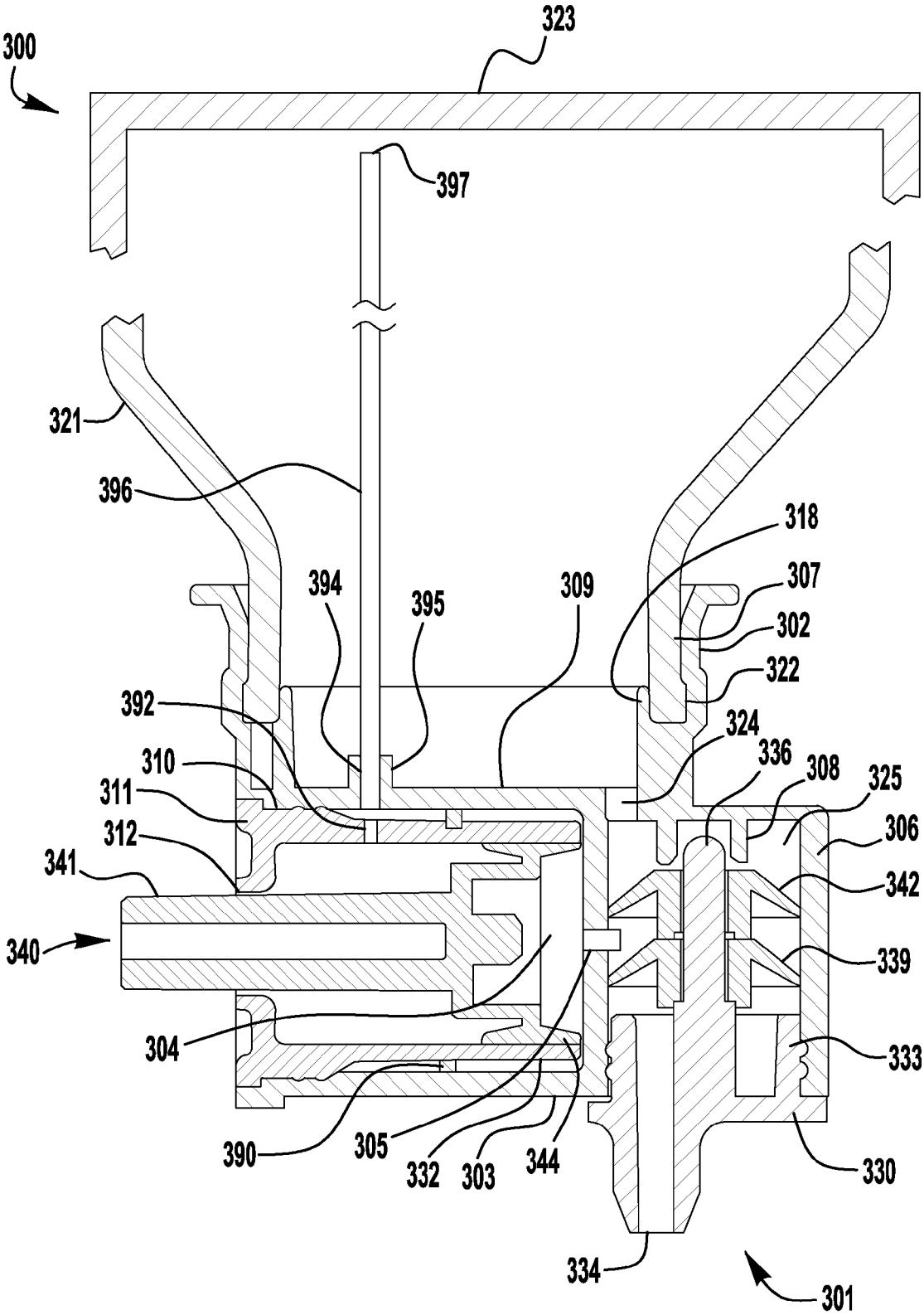
FIG. 3 is a cross-section of an exemplary refill unit with a pump having a simplified inlet and outlet valve and a container vent.

FIG. 3 is a cross-sectional view of an exemplary embodiment of a refill unit 300 suitable for use in a dispensers. Refill unit 300 includes a non-collapsible container 321 for holding a liquid connected to a pump 301. Pump 301 includes a housing 302. Housing 302 includes an annular collar 307 and an interior annular projection 318 that forms an annular groove 322 for receiving the neck of container 321. Housing 302 may be connected to the container 321 by any means such as, for example, a snap-fit connection, a threaded connection, a welded connection, an adhesive connection or the like.

Housing 302 includes a base 309. Base 309 includes a liquid inlet aperture 324 that leads into a valve cavity 325, placing the valve cavity 325 in fluid communication with container 321. Valve cavity 325 is formed in part by wall 306. Located within valve cavity 325 is an annular projection 308 that serves to retain valve stem 336. Valve stem 336 is part of lower housing 330. Lower housing 330 includes an annular projection 333 to secure to the wall 306 of housing 302. Lower housing 330 may be secured to housing 302 by any means, such as, for example, a snap-fit connection, a threaded connection, an adhesive connection, a welded connection or the like. Lower housing 330 also includes an outlet 334 for dispensing a fluid. Valve stem 336 supports inlet valve 342 and outlet valve 339 which are stacked on top of each other. Located in a wall of valve cavity 325, in between the inlet valve 342 and the outlet valve 339 is an aperture 305. Aperture 305 places the valve cavity 325 in fluid communication with pump chamber 304. Inlet valve 342 and outlet valve 339 are one-way valves and allow liquid to pass in one direction. The valves are simple wiper valves and are interchangeable with each other.

Pump housing 302 includes a pump chamber 304. In one embodiment pump chamber 304 is cylindrical. Located at least partially within pump chamber 304 is a sleeve 332. Housing 302 includes an annular projection 310 at one end of the pump chamber 304. Sleeve 332 is secured to annular projecting member 310 by collar 311. The connection may be any type of connection, such as, for example, a snap-fit connection, a threaded connection, an adhesive connection, a welded connection or the like. Collar 311 includes an aperture 312.

A piston 340 includes a shaft 341 that projects through aperture 312. Piston 340 is slideable in a reciprocating manner within sleeve 332. Piston 340 includes a piston head having a double wiper seal 344 located at the distal end. Movement of piston 340 causes the volume of pump chamber 304 to expand and contract. Double wiper seal 344 may be any type of sealing member such as, for example, an o-ring, a single wiper seal or the like.

Sleeve 332 includes an aperture 392. Aperture 392 places the area between the sleeve 332 and the housing 302 in fluid communication with the atmosphere when the liquid piston is moved forward as illustrated in FIG. 3. When the piston 340 moves outward, piston double wiper seal 344 closes off aperture 392 and seals aperture 392 from the atmosphere. Located around sleeve 332 is a sealing member 390. Sealing member 390 seals the area between sleeve 332 and housing 302 to prevent liquid from passing from the pump chamber 304 into the area that is periodically open to the atmosphere when the piston double wiper seal 344 is moved off of aperture 392.

Base 309 of housing 302 includes an aperture 394, which may include an annular projection 395. A vent tube 396 is inserted into aperture 394 and projection 395. The top 397 of the vent tube 396 is located proximate the top 323 of container 321 allowing the air to vent the container without fluid traveling down the vent tube 396 into the area between the sleeve 332 and housing 302. In one embodiment, piston 340 is moved outward to seal off aperture 392 during shipping.

In addition, although the pump 301 has been described as being made of selected sub-parts, pump 301, as well as the other embodiments of pumps disclosed herein, may be made from more sub-parts or fewer sub-parts.

During operation, as piston 340 of pump 301 moves from a discharged position (as illustrated in FIG. 3) to a charged position or primed state, liquid flows into valve cavity 325 through liquid inlet aperture 324, past one-way liquid inlet valve 342, through aperture 305 and into pump chamber 304 to charge the pump 301 or place the pump 301 in the charged position.

Movement of piston 340 from the charged position to the discharged position causes fluid to flow out of the pump chamber 304 back into valve chamber 325. One-way liquid inlet check valve 342 prevents liquid from flowing back into container 321 and accordingly, the liquid flows past one-way liquid outlet valve 339 into outlet nozzle 334 where it is dispensed to a user.

Pumping liquid out of container 321 causes a vacuum to develop in container 321. When the piston 340 is moved toward the discharged position and double wiper seal 344 moves off of air inlet aperture 394, the vacuum pressure draws in air from the atmosphere up the vent tube 396 into the container 321.

In some embodiments, pump 301 is used without the vent tube 396, aperture 394 and sealing member 390 and used with a collapsible container instead of a non-collapsible container.

Figure 4:
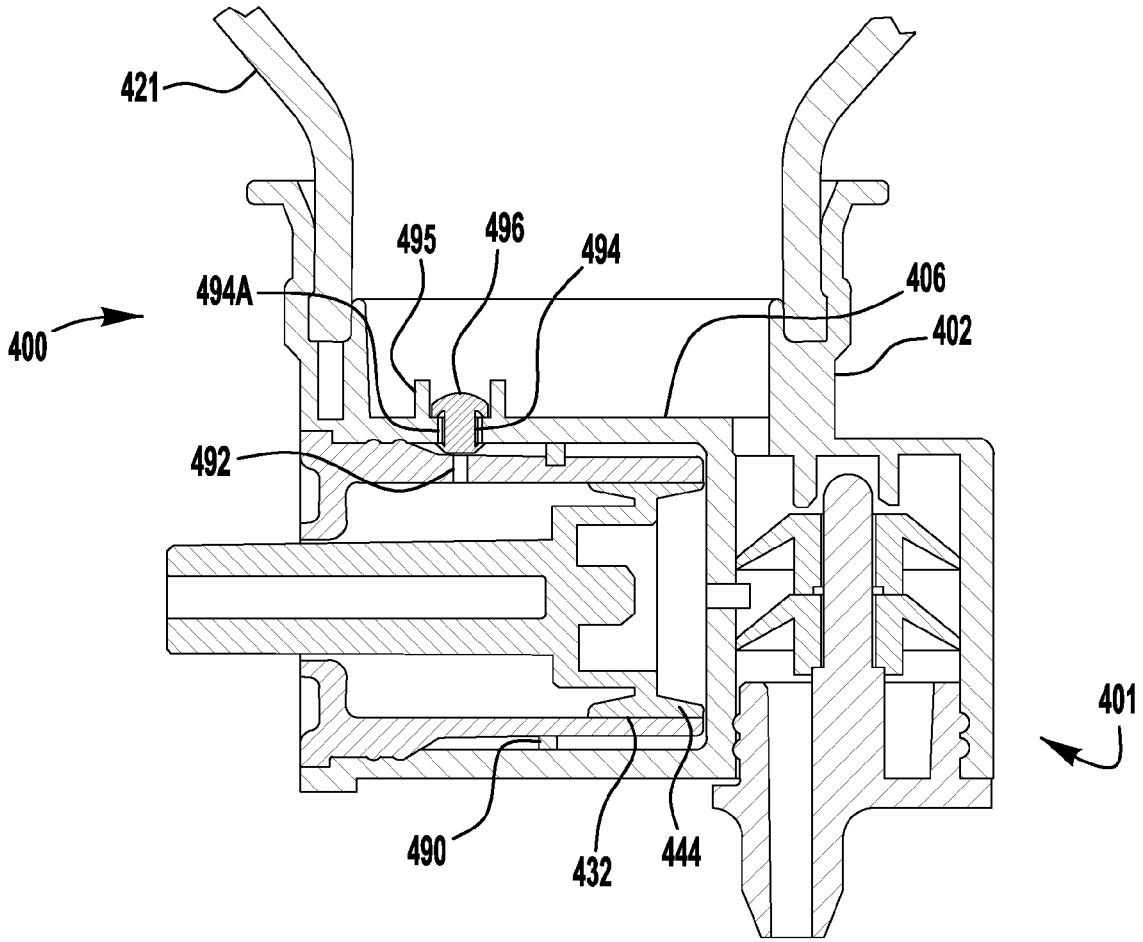
FIG. 4 illustrates another cross-section of an exemplary refill unit with a pump having a simplified inlet and outlet valve and a container vent.

FIG. 4 is another exemplary embodiment of a refill unit 400. Pump 401 is substantially similar to pump 301. The liquid pumping portion is so similar, the components are not renumbered with respect to FIG. 4, and only the venting components are described with respect to FIG. 4. Pump 401 includes a venting aperture 492 through a wall of sleeve 432. An aperture 494 is through base 406 of housing 402. An annular projecting member 495 projects up from base 406 around aperture 494. Additional air inlet apertures 494A may be included around aperture 494 if aperture 494 is used solely to anchor one-way air inlet valve 496 to base 406. Optionally, air may flow through grooves (not shown) in the base of one-way air inlet valve 496 and through aperture 494. A sealing member 490, such as, for example, an o-ring provide an air passage between sleeve 432 and base 402 for air to flow to one-way air inlet valve 496. One-way air inlet valve 496 allows air to flow into container 421 once sufficient vacuum pressure builds within container 421 to overcome the cracking pressure of valve 496. Operation of pump 401 and the venting system is similar to the operation of the prior embodiments and will not be re-discussed herein.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

We claim:

1. A refill unit comprising:
an inverted container for holding a fluid;
the inverted container having a neck portion located on the bottom of the inverted container;
a pump housing secured to the neck of the inverted container to pump liquid;
the pump housing having an annular collar for securing to the neck of the inverted container;
an air chamber located within the pump housing;
a vent valve located at least partially within the air chamber;
one or more air passageways between the collar and the neck for providing air to the air chamber;
a compressible liquid pump chamber located in the housing;
a liquid inlet valve for allowing liquid to flow from the container into the compressible pump chamber; and
a liquid outlet valve located downstream of the pump chamber.

2. The refill unit of claim 1 wherein the vent valve is located adjacent the liquid inlet valve.

3. The refill unit of claim 1 further comprising a seat member, wherein the seat member comprises an air passage and a liquid passage, and the vent valve is located proximate the air passage and the liquid inlet valve is located proximate the liquid passage.

4. The refill unit of claim 3 wherein the neck of the inverted container is in contact with the seat member.

5. The refill unit of claim 3 wherein the seat member further comprises a deflector member for deflecting air entering the container away from the liquid passage in the seat member.

6. The refill unit of claim 1 further comprising a compressible air chamber and a mixing chamber, wherein the mixing chamber has an air inlet in fluid communication with the compressible air chamber and a liquid inlet downstream of the liquid outlet valve and in fluid communication with the liquid pump chamber.

7. The refill unit of claim 1 further comprising a liquid contained in the inverted container.

8. The refill unit of claim 1 wherein the air passage is located between a wall of the collar and a wall of the inverted container.

9. A refill unit comprising:
a container for holding a fluid;
a pump housing secured to the container;
the pump housing having an annular collar for securing the pump to the container;
a seat member located at least partially within the annular collar;
an air chamber located within the pump housing below the seat member;
one or more air passageways in the collar for providing air to the air chamber;
a vent valve secured to the seat member for controlling the flow of air from the air chamber into the container;
a compressible liquid pump chamber located in the housing;
a liquid inlet valve secured to the seat member for allowing liquid to flow from the container into the compressible pump chamber; and
a liquid outlet valve located downstream of the pump chamber.

10. The refill unit of claim 9 wherein the air passage is located between a wall of the collar and a wall of the container.

11. The refill unit of claim 9 wherein the container is in contact with the seat member.

12. The refill unit of claim 9 wherein the seat member further comprises a deflector member for deflecting air entering the container away from the liquid passage in the seat member.

13. The refill unit of claim 9 wherein the seat member is a single unitary piece.

14. A refill unit comprising:

an inverted container for holding a fluid;

the inverted container having a neck portion located on the bottom of the inverted container;

a pump housing secured to the neck of the inverted container to pump liquid;

the pump housing having a collar;

an air chamber located within the pump housing;

a vent valve located at least partially within the air chamber, selectively opening to vent the container;

one or more air passageways between the collar and the neck of the container for providing air to the air chamber;

a compressible liquid pump chamber located in the housing;

a liquid inlet valve for allowing liquid to flow from the container into the compressible pump chamber; and a liquid outlet valve located downstream of the pump chamber.

15. The refill unit of claim 14 wherein the vent valve is located adjacent the liquid inlet valve.

16. The refill unit of claim 14 further comprising a seat member, wherein the seat member comprises an air passage and a liquid passage, and the vent valve is located proximate the air passage and the liquid inlet valve is located proximate the liquid passage.

17. The refill unit of claim 16 wherein the seat member further comprises a deflector member for deflecting air entering the container away from the liquid passage in the seat member.

18. The refill unit of claim 14 wherein the air passage is located between a wall of a collar and a wall of the inverted container.

19. A refill unit comprising:

a container for holding a fluid;

a pump housing secured to the container;

the pump housing having an collar for securing the pump to the container;

a seat member;

an air chamber located within the pump housing below the seat member;

one or more air passageways formed between the collar and the neck for providing air to the air chamber;

a vent valve for controlling the flow of air from the air chamber into the container;

a compressible liquid pump chamber located in the housing;

a liquid inlet valve secured to the seat member for allowing liquid to flow from the container into the compressible pump chamber; and a liquid outlet valve located downstream of the pump chamber.

20. The refill unit of claim 19 wherein the air passage is located between a wall of the collar and a wall of the container.

21. The refill unit of claim 19 wherein the container is in contact with the seat member.

22. The refill unit of claim 19 wherein the seat member further comprises a deflector member.

* * * * *